United States Patent [19]

Lineberg

[11] 3,963,535

[45] June 15, 1976

[54] METHOD FOR CONTROLLING QUENCHING

[75] Inventor: Birger David Lineberg, Koping, Sweden

[73] Assignee: AB Volvo, Goteborg, Sweden

[22] Filed: July 20, 1973

[21] Appl. No.: 381,068

[30] Foreign Application Priority Data

July 28, 1972 Sweden ..... 9914/72

[52] U.S. Cl. ..... 148/144; 148/143

[51] Int. Cl.[2] ..... C21D 1/18

[58] Field of Search ..... 148/18, 13.1, 20.6, 148/143, 144; 62/64; 266/4 A, 4 R

[56] References Cited

UNITED STATES PATENTS

| | | | |
|---|---|---|---|
| 1,834,702 | 3/1931 | Hafer | 266/6 R |
| 2,672,430 | 3/1954 | Simons | 148/143 X |
| 3,164,656 | 1/1965 | Ipsen | 148/143 X |
| 3,415,694 | 12/1968 | Engelhard | 148/143 X |
| 3,441,453 | 4/1969 | Western | 266/4 A X |
| 3,633,895 | 1/1972 | Genrich | 266/4 A |
| 3,669,762 | 6/1972 | Takeo et al. | 148/18 |

*Primary Examiner*—Arthur J. Steiner
*Attorney, Agent, or Firm*—Young & Thompson

[57] ABSTRACT

A method for regulated cooling of hot objects by liquid medium or media in which the cooling is varied by varying the pressure under which said cooling takes place, and means for carrying out the method, said means comprising an open or closed container for the cooling agent or agents having means for regulating the temperature of the cooling agent, means for stirring the cooling agent, means for conveying the cooling agent to a shaft-constituting part of the container, means for inserting the object into the shaft and means for regulating the pressure of the cooling agent in said shaft.

4 Claims, 5 Drawing Figures

METHOD FOR CONTROLLING QUENCHING

Figure 1:
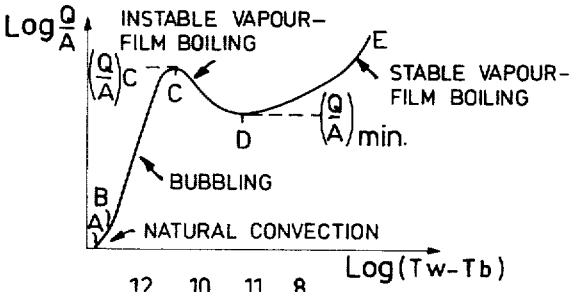

The present invention relates to a method for controlling quenching in a hardening process.

Of the different factors influencing the hardening result, it is, today, possible to satisfactorily control all of them with the exception of the actual quenching sequence. It is possible to choose steel having suitable hardenability as well as measure and regulate temperature, time and heat input in the heating furnace. However, control and regulation of the quenching of the hardening material gives rise to great problems. During theoretical as well as experimental research of the heat transfer from a liquid cooling agent to a solid body, it has been found that the heat transfer is dependent upon the properties, temperature and stirring of the cooling agent and, on a large scale, even the pressure that prevails in and above the liquid.

Increased pressure leads to increased heat transfer in otherwise unchanged conditions in the cooling agent. A purpose of the invention is to, with the help of pressure, affect (preferably increase) the quenching speed. The pressure which is prevalent in or above the cooling agent provides an extra variable which, during the course of the quenching, makes it possible to regulate said quenching to a desired intensity, whereby the following advantages are gained:

1. It is possible to choose a steel having a lower alloying content than it has when quenching takes place in atmospheric pressure.
2. The hardening penetration and hardness of a given material can be regulated.
3. Different quenching rates in different temperature ranges can be obtained by change in pressure. In some cases, it can be desirable to carry out a rapid initial quenching, which is then followed by a slower one (which can be obtained by a reduction in pressure) down through the temperature range where martensite is formed.
4. A very powerful heat transfer is obtained by adjusting the pressure so that it is held at a pressure which corresponds to the saturation pressure of the cooling agent at a surface-temperature of the hardening material.

The method of regulated cooling of hot objects by a liquid cooling agent or agents is characterized in that the cooling is adjusted by varying the pressure under which the cooling takes place.

The pressure can be chosen either above or below atmospheric pressure. Even if the process is optimized by continuously varying the pressure with the temperature throughout the cooling sequence, a great improvement in said cooling sequence is obtained by, before the cooling begins, applying a pressure which provides an optimal cooling speed at a temperature or in a temperature range and, when said temperature or temperature range is achieved, quickly changing the pressure to a lower value above or below the atmospheric pressure.

A device for carrying out the method according to the invention comprises an open or closed container for the cooling agent or agents, having a means for regulating the temperature of said agent, an arrangement for stirring said cooling agent, an arrangement for conveying said agent to a shaft-constituting part of the container and an arrangement for inserting the object which is to be cooled into the shaft.

In a preferred embodiment of the device according to the invention, the transfer-arrangement is so arranged as to influence the pressure in the shaft and the arrangement for inserting the object into said shaft is formed in such a manner that the shaft constitutes a closed room when the object which is to be cooled is conveyed down into the cooling agent in the shaft. The container or the shaft is equipped with inlets and outlets for the cooling agents, and can be affected by the pressure which is prevalent in the shaft.

According to the invention, the container which is intended for the cooling agent can be closed and, above the surface of said cooling agent in said container, it is possible to arrange a compressible gas entering into a closed, adjustable system in order to regulate the pressure in the gas and also regulate the pressure in the cooling agent. It is also possible to supply the cooling agent with a fluid having a lower evaporation temperature than the cooling agent in the shaft in order to affect the pressure in said shaft. This supply can flow into the container from its outer side. The cooling agent in the shaft is heated to a temprature corresponding to the evaporation temperature prevalent in the shaft.

A device for the insertion of the object which shall be cooled can be designed as an open at the top, closed at the bottom container, surrounding said object and designed to seal against the upper portion of the shaft.

The invention shall be described in more detail in connection with the enclosed drawing where:

FIG. 1 shows a schematic course of the quenching and

FIGS. 2–5 schematically show arrangements for carrying out the method according to the invention.

The following description relates to quenching of metals which have been heated to a high temperature, but it is not intended to constitute any limitation of the method according to the invention.

As regards the behavior of the cooling agent, it is well known that quenching can be divided-up into four stages, namely, a high-temperature stage, having a duration of fractions of seconds, a vapour-film boiling stage, having a duration of 10–15 seconds, a bubbling stage, having a duration of 15 seconds to 3 minutes and a convection stage, having a duration of 3–4 minutes. The high temperature stage is characterized in that the contact between the cooling agent and the very hot surface of the metal causes an intensive heat transfer. This powerful heat transfer lasts for only a few moments. Afterwards, a vapour-film is formed around the metal, said film greatly reducing the heat transfer between the cooling agent and the metal. This is illustrated in FIG. 1 by area DE, which defines the heat transfer per surface unit Q/A from the surface of the metal to the surrounding cooling agent as being a function of the temperature difference $T_W - T_b$ between the surface of the metal and the cooling agent. Area DC, between point D, where the stable vapour-film boiling begins and point C, where maximal bubbling prevails, is named instable vapour-film boiling and is characterized by an alternating growth and collapse of the vapour. The heat transfer is powerful and stable from C to B. A large number of bubbles is formed in this area, resulting in that the heat transfer increases greatly. In area BA, the heat transfer takes place through natural convection. Cooling is noticeably reduced and the value of the heat transfer decreases.

With an increase in pressure in the method according to the invention, it is possible to obtain bubbling in a significantly large area than could be obtained by a definite pressure, that is, area BC in FIG. 1 extends through an increased temperature range.

The pressure also affects the temperature at which vapour-film boiling goes over to bubbling, and, due to the change of the boiling point by pressure, also affects the temperature at which the heat transfer by bubbling goes over to heat transfer by convection. An increase in pressure results in vapour-film boiling going over to bubbling at higher temperatures, which is essential to a rapid initial quenching.

Figure 2:
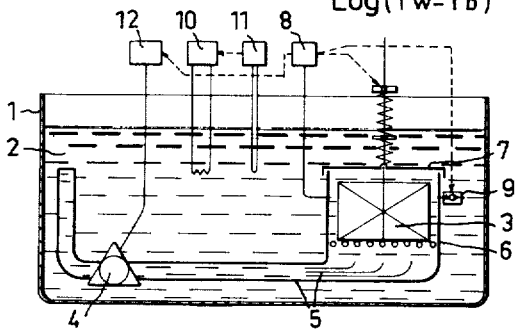

An arrangement according to the invention is shown by FIG. 2, where 1 is a container having a cooling agent 2 which is conveyed to the object 3 (which is to be cooled) by a pump 4 via a system of pipes and guides 5. The object is conveyed in the vertical shaft 6, arranged within the container by an elevator arrangement designed so that a cover 7 seals against the upper part of the shaft. The desired pressure in the shaft is obtained partly by the pump 4 and partly by the cover 7 which is arranged to open, with the help of regulating means 8, at a predetermined pressure inside the shaft.

The direction of rotation of the pump 4 is chosen so that pressure above atmospheric or low pressure is obtained. When low pressure is wanted, the desired stirring and pressure is obtained by the cooling agent being conveyed to the shaft via pressure-dependent inlet valves 9. The temperature of the cooling agent is regulated by, for example, immersion heaters 10 via temperature regulating equipment 11. The stirring of the cooling agent is also regulated by the pump 4 via the rpm regulating equipment 12 of said pump 4.

Figure 3:
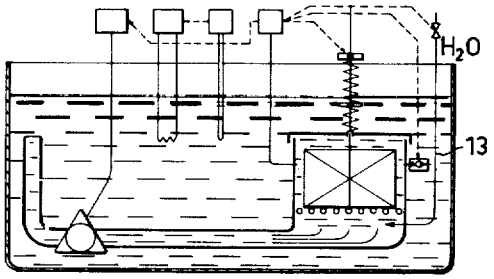

Another embodiment for obtaining desired pressure in the cooling agent is shown by FIG. 3. This embodiment can be used alone or in combination with the arrangement according to FIG. 2. The arrangement according to FIG. 3 is mainly similar to the arrangement shown in FIG. 2, but is completed with an arrangement to, in a regulated manner, supply the cooling agent with a liquid which has a lower evaporating temperature than the actual cooling agent. If the cooling agent is, for example, oil, which is heated to a temperature higher than 100°C by the heating arrangement 10 or locally by the object which is to be hardened, water, for example, can be supplied by a pipe 13. The water is evaporated instantaneously, thereby causing a rise in pressure which, in size and duration, can be regulated, partly by the supplied amount of water and the time in which it is supplied and partly by the pressure-regulating system according to FIG. 2. Naturally, oil having a temperature higher than 100°C can be supplied with water from a receptacle which stands in contact with the cooling agent in the shaft 6 and thereby obtain a rapid increase in pressure in the cooling agent.

Figure 4:
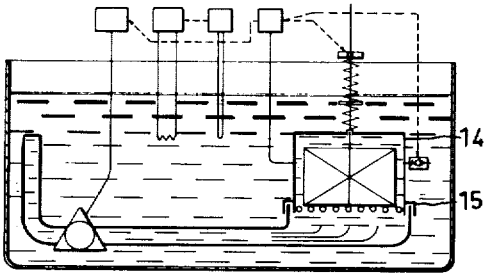

FIG. 4 shows another embodiment of an arrangement in the invention. The embodiment is based on the object being placed inside a bell 14 before it is submerged in the cooling agent. When the bell containing the object is submerged in the cooling agent, pressure is built up, depending partly upon how deep the bell and the object are submerged in the cooling agent, and depending partly on the increase in volume which takes place when the object 3 heats the cooling agent which is in the bell 14. This pressure is regulated in the same way as in the previous embodiments, i.e. by a seal 15. It is understood that this embodiment can be used alone or in combination with any of the above-cited embodiments according to FIGS. 2 and 3.

Figure 5:
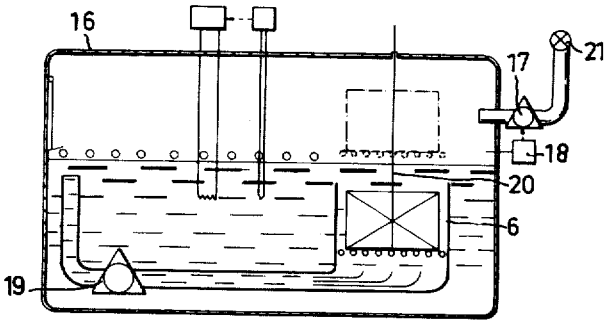

FIG. 5 shows a fourth embodiment of an arrangement according to the invention. The cooling agent is, here, completely enclosed in the container and desired pressure in the cooling agent is obtained by the pressure in a gaseous medium above the surface of the liquid being raised or lowered by an arrangement 17, gas admission 21 and regulating means 18 before the object to be quenched is submerged in the cooling agent. The cooling agent is stirred by a pump 19 and the temperature of the medium is regulated by an arrangement similar to that shown in FIG. 2. The flow of the cooling agent is regulated by pipes and guides 5 and the shaft 6. The elevator arrangement 20 can be applied without any part of said elevator arrangement having to seal against the shaft 6. It is clear that even this embodiment can be used in combination with any one or more of the arrangements according to FIGS. 2–4.

As persons skilled in the art can easily understand, other embodiments are conceivable for obtaining an increase in pressure and a decrease in pressure, respectively, in a cooling agent during a quenching operation and even the presently shown arrangement can be modified to achieve the same result without departing from the actual inventive idea.

What I claim is:

1. A method for the regulated quenching of hot steel objects in liquid, comprising submerging a hot steel object in a liquid which is at superatmospheric pressure, and after said hot steel object is submerged in the liquid reducing the pressure of the liquid in which the hot steel object is submerged, thereby to effect a rapid initial quench followed by a slower one down through the temperature range where martensite is formed.

2. A method as claimed in claim 1, in which said superatmospheric pressure is achieved by pumping said liquid into an enclosure that receives said hot steel object.

3. A method as claimed in claim 1, in which said superatmospheric pressure is achieved by injecting into an enclosure that receives said hot steel object a fluid whose boiling temperature is below the temperature of said liquid.

4. A method as claimed in claim 3, in which said liquid is oil and said fluid is water.

* * * * *